United States Patent [19]

Bartley

[11] 3,961,712

[45] June 8, 1976

[54] INDUSTRIAL BUILDING STRUCTURE SYSTEM

[75] Inventor: Thomas S. Bartley, Mobile, Ala.

[73] Assignee: International Paper Company, New York, N.Y.

[22] Filed: Oct. 31, 1974

[21] Appl. No.: 519,647

[52] U.S. Cl. ..... 212/5; 52/66; 212/14

[51] Int. Cl.[2] ..... B66C 17/06

[58] Field of Search ..... 212/5, 6, 4, 11, 13, 212/14; 52/33, 66, 29; 214/16 B

[56] References Cited

UNITED STATES PATENTS

| | | | |
|---|---|---|---|
| 1,671,252 | 5/1928 | Moore | 212/11 |
| 1,701,965 | 2/1929 | Wood | 212/4 X |
| 3,259,250 | 7/1966 | Parker et al. | 212/13 |
| 3,283,923 | 11/1966 | Schnyder | 212/4 X |

*Primary Examiner*—M. H. Wood, Jr.
*Assistant Examiner*—John A. Pekar
*Attorney, Agent, or Firm*—Finnegan, Henderson, Farabow & Garrett

[57] ABSTRACT

An industrial building structure system is provided having a overhead crane and hoist system. More particularly, a building has a series of longitudinally aligned sections each with removable roof structures over which a gantry-type crane housing can be moved. Individual roof sections are removed by the appropriate crane mechanism within the crane housing and other cranes mounted within the crane housing can be used for normal repair or maintenance work within the interior of the particular building section. A much reduced size building is thereby provided with an overhead crane system which can operate inside the building. Provision is made to enclose the building section when the roof is raised by adjustable end wall members on the crane housing.

10 Claims, 7 Drawing Figures

INDUSTRIAL BUILDING STRUCTURE SYSTEM

BACKGROUND OF THE INVENTION

This invention relates to building structures and more particularly to those structures required for industrial manufacture. Particularly in a continuous manufacture process operation an overhead crane system, operating on lateral and longitudinal track systems, is essential. The building disclosed herein, although not incorporating an overhead crane system into its interior construction does provide a system with all the flexibility required while allowing for a smaller more economical building structure.

This type of building is particularly adaptable to housing machinery, e.g. a paper machine, for use in a continuous process activity. If a particular process requires continuous operation of all stages, interruption of any one stage is costly. This building makes possible utilization of an overhead crane system which is not an integral part of the building without interruption of the total process operation.

In the manufacture of paper for instance where large machines and complicated operations are involved and a building may be a city block in length, an adequate overhead crane system must be available within the building to move equipment for repair or replace heavy machinery or provide other maintenance functions.

In paper making, a slurry comprised of a suspension of fibers and other ingredients is continuously fed onto a continuously moving wire belt or screen. A formed sheet is removed continuously and passes over various rolls, suction boxes and through other drying stages. Each of these devices causes water to drain through the wire and as this water is removed the sheet is formed. Various drainage, pressing and drying operations are performed on the sheet as it progresses through the paper machine building. The final surface qualities of the paper are determined in the calendering step and the paper is eventually wound on cylinders prepared for either shipment or storage.

Clearly the paper making type of process requires a continuous operation. Further it requires a building which can be well ventilated since water removal is a major part of the process.

Traditionally, industrial buildings, including paper machine buildings, are constructed much larger than would be necessary if the only consideration were housing the particular machinery itself. Extra height and width of a building is utilized for a superstructure which supports and carries various overhead cranes and hoists. This type of superstructure must extend the entire length of the building. The hoist and crane mechanisms must also run on tracks both laterally and longitudinally of the building to provide complete flexibility for the various functions required of it.

To construct a superstructure within a building as is required for an overhead crane system is extremely costly. It has been, however, an essential interior part of most manufacturing buildings since they must be enclosed and protected from weather while the machine are operating. A building housing a paper machine for instance must be closed to the elements to avoid damage to machines and the process. Consequently, to perform various maintenance functions, as always in the past, required a completely enclosed building with the crane system incorporated into the interior.

SUMMARY OF THE INVENTION

The present invention overcomes the problems of the prior art by providing a gantry-type crane housing which moves exterior to and longitudinally along a building to provide a crane and hoist system for use in the interior of the building. Considered in its broadest aspects, the building structure in combination with the crane housing allows for a significantly smaller total structure while preserving all the flexibility and functions of an internally mounted overhead crane system. The interior of the building need never be exposed to the weather and adverse elements while the crane system is being used.

The industrial building structure system of this invention, which permits overhead crane suspension of machinery positioned within the building, is comprised of a plurality of building sections aligned in a longitudinal direction characterized by each having removable roof structures, a crane housing which spans the width of the building and has side wall members exterior to and adjacent the sides of the building, the crane housing being mounted on wheels which cooperate with parallel tracks on each side of the building, and the crane housing further having mounted therein an overhead crane system.

Preferably the crane system includes a first crane fixidly attached to the top structure of the crane housing adapted to raise and lower the roof sections of the building.

It is also preferred that the crane system include additional hoists capable of lateral movement relative to the building and adapted to perform the normal functions of an overhead crane system within a manufacturing facility.

It is also preferred that the crane housing has end wall sections which are adjustable vertically to substantially enclose longitudinal sections of the building in conjunction with the top structure and the side wall members regardless of the particular building cross-section.

The invention consists in the novel parts, constructions, arrangements, combinations and improvements shown and described. The accompanying drawings, which are incorporated in and constitute a part of the specification, illustrate one embodiment of the invention, and together with the description, serve to explain the principles of the invention.

DESCRIPTION OF THE PREFERRED EMBODIMENT

Reference will now be made in detail to the present preferred embodiments of the invention, examples of which are illustrated in the accompanying drawings.

Figure 1:
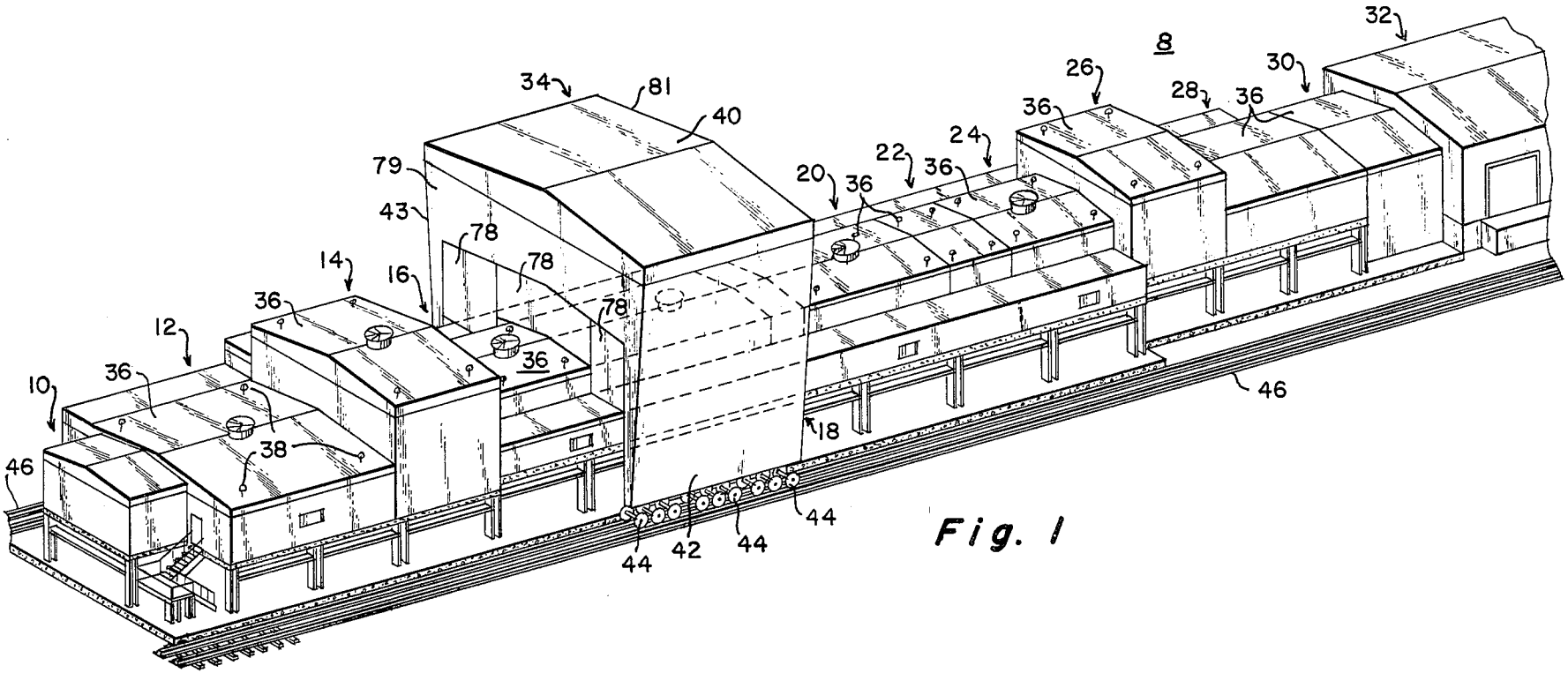
FIG. 1 is an isometric front view of an industrial building structure system including an overhead crane system in accordance with this invention and illustrated with respect to housing paper producing and processing machinery.

Referring now to FIG. 1, an industrial building structure system 8 incorporating the features of this invention is shown in an isometric front view. The building 8 must enclose large and complicated machinery used to convert the dilute aqueous suspension of fibers and other ingredients into the finished dry paper usually wound on rolls for either storage or shipment. Such a building is consequently quite long.

Neither the particular details of the paper making process nor the actual machinery used constitute a part of the invention described herein. Consequently, they are described only to the extent necessary to assist one skilled in construction to understand the structure and utility of this type of an industrial building.

According to this invention, a paper machine building 8 is shown comprised of a series of sections aligned in a longitudinal direction including a head box 10, a fourdrinier section 12, press 14, a first dryer section 16, a breaker stack section 18, a second dryer section 20, a size press section 22, a third dryer section 24, a calender section 26, a winder section 28, and a ramp and warehouse 30 and 32.

The building 8 of course is constructed as a single long structure but sectionalized as to steps in the process and location of machinery. As here embodied each section 10–32, has a removable roof structure 36 mounted thereon, the size of each structure 36 being determined by the particular building section 10–32 which it must cover.

It is preferred that the various removable roof structures 36 have mounted thereon fittings 38 which can receive a releasable hooking type device. Preferably a plurality of eye ring fittings 38 are fixedly mounted on each roof structure 36. Although the size of the roof structures 36 can vary, the eye ring fittings 38 are arranged similarly on each to cooperate with the hoisting system used.

In accordance with this invention a crane housing 34 has a top structure 40 which laterally spans the roof structures 36 of the building sections 10–32. The crane housing 34 further has side wall members 42 and 43 which support the top structure 40 and are positioned exterior to the side of the building sections 10–32, but closely adjacent thereto. As here embodied the crane housing 34 is actually a gantry crane wherein the top structure 40 constitutes the bridge for carrying a crane system and which is rigidly supported by the side wall members 42 and 43. The members 42 and 43 typically include columns with a supporting truss structure as is well-known in the construction trades.

Preferably, the supporting side wall members 42 and 43 have transit means attached for providing movement of the crane housing 34 in a longitudinal direction relative to the connected building sections 10–32.

Figure 2:
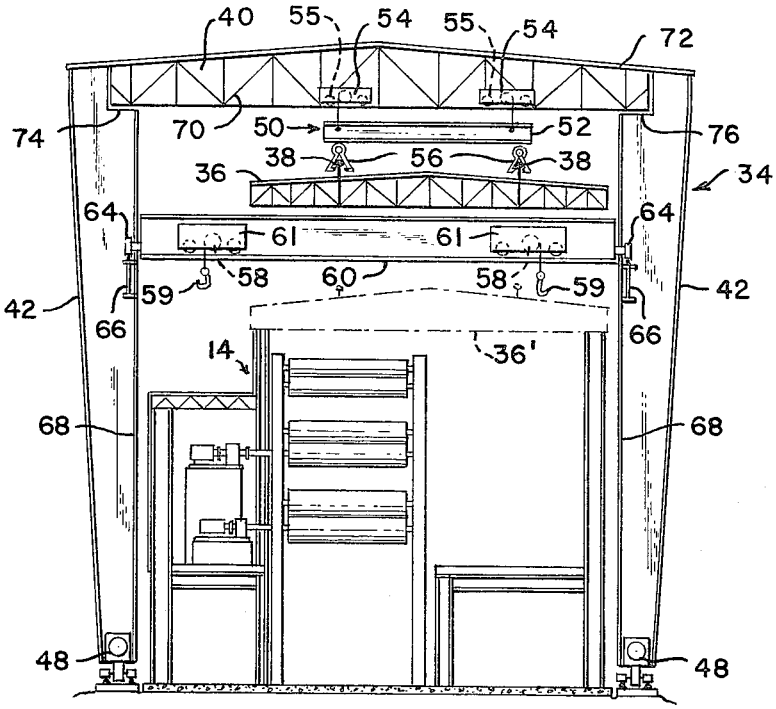
FIG. 2 is a cross-sectional view through the crane housing and the press section of the building of FIG. 1.

Preferably, the transit means comprise sets of wheels 44 which cooperate with fixed rails or tracks 46 running adjacent and parallel to each long side of the building 8. The wheels 44 are driven by a drive motor system 48 which can conveniently be attached to each of the respective side wall members 42 and 43, as shown in FIG. 2. It will be understood that the drive motor system 48 need not be shown in detail, such a system being easily connected to drive the wheels 44.

Figure 3:
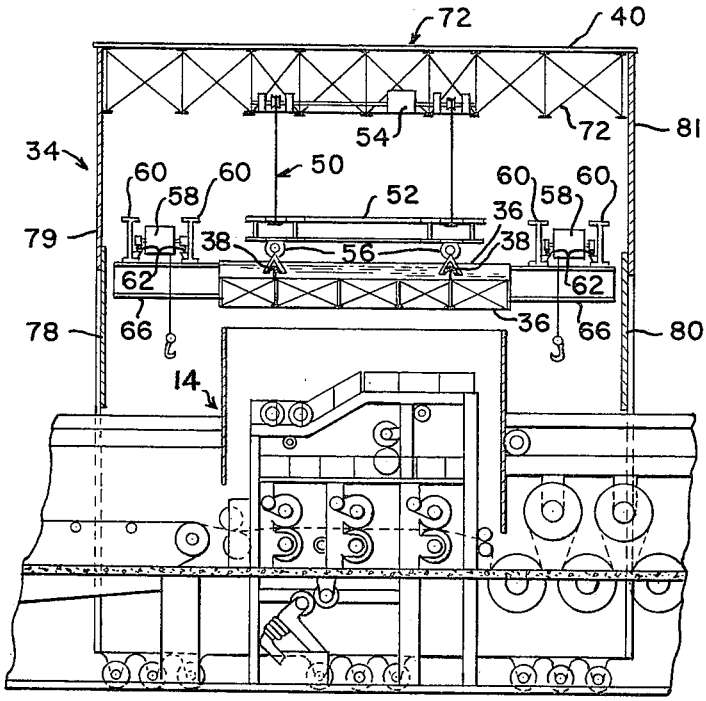
FIG. 3 is a longitudinal-section view through the crane housing and the press section of the building of FIG. 1.

In accordance with this invention and as more clearly shown in FIGS. 2 and 3, the crane housing generally 34 has mounted thereon a first overhead crane means generally 50 for removing the roof structures 36. As here embodied a rigid structural framework 52 is supported by a hoist mechanism 54 which is movably mounted on the top structure 40 by appropriate trolley means 55. Further, releasable clamp members, as here embodied in a double hook mechanism 56, attach to the eye ring fittings 38 for raising and lowering the roof structures 36. The double hook attaching mechanisms 56 can be welded or bolted to the rigid frame structure 52.

The double hook attaching mechanisms 56 are arranged on the rigid structural framework 52 to cooperate with a plurality of fitting means 38 mounted on any particular removable roof structure 36 so that the structures 36 may be raised and lowered smoothly and safely. Preferably the framework 52 is an open rectangular configuration as shown in FIGS. 2 and 3 having the double hook attaching mechanisms 56 attached near each corner of the framework.

In accordance with this invention, the crane housing 34 also has mounted thereon a second overhead crane means. As here embodied, movable hoist mechanisms generally 58 are provided. The hoist means are driven by appropriate motor means which are not shown, and include a hoisting apparatus 59 and a trolley 61 carried by lateral track means having ends fixedly bolted to respective side wall members 42 and 43.

Preferably the track means includes a pair of I beams 60 spaced apart sufficiently as illustrated in FIG. 3 to provide a double I beam track 62 for the movable hoist mechanisms 58. Each end of each I beam 60 is bolted, as illustrated in FIG. 2, by means 64 to the interior structure 68 of side members 42 and 43 respectively and further are supported by I beams horizontally mounted and welded to the interior framework 68 of the respective side members 42 and 43.

Preferably top structure 40 includes a truss-like bridge framework 70 which provides strong and rigid support for the first crane means 50. The bridge framework 70 is supported on either end by the side wall members 42 and 43 at points 74 and 76 respectively.

Roof 72, of an appropriate roofing material, is laid on top of the bridge framework 70 and preferably extends outwardly of the respective side wall members 42 and 43.

As shown in FIGS. 2 and 3, the first overhead crane means 50 can be positioned to raise or lower the removable roof structure 36. As illustrated in FIGS. 2 and 3, roof structure 36 is in a raised position, the dotted lines 36′ in FIG. 2 illustrate the roof structure in a lowered position over the building press section 14.

It is preferred that end wall sections 78 and 80 FIG. 3 be mounted on respective ends of the crane housing 34 as illustrated in FIG. 1 and be movable vertically with respect to fixed end walls 79 and 81 to form continuous end walls and to permit adjusting the level of the lower edge of the end walls. Preferably the wall sections 78 and 80 are mounted to slide on tracks and are raised or lowered by means of appropriate hoisting equipment.

As shown in FIG. 1, it is preferred that three end wall sections 78 and three end walls sections 80 be provided across each end of housing 34 to enclose it, thereby conforming to the roof outline of the building section. The central end wall section has a bottom edge which conforms to the slope of the roof sections 36. Once the end wall sections 78 and 80 are in the lowered position in contact with the various roof sections 36, the crane housing 34 as defined by the top structure 40, the respective side wall members 42 and 43, and the end walls completely encloses a longitudinal section of the building 8. This feature of the total crane housing 34 permits maintenance and repair work to be accomplished without exposing the interior of the building to the outside elements.

Details of the track construction for the wall sections 78 and 80 are not herein shown, because such details are well within the skill of the average mechanic.

Figure 4:
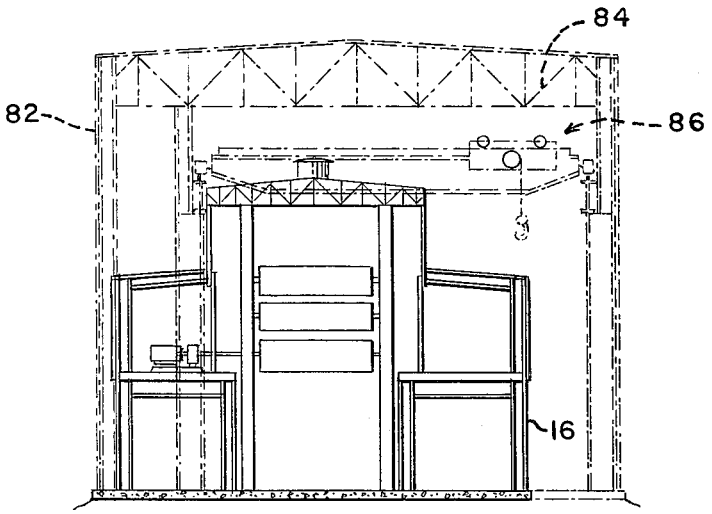
FIG. 4 is a cross-sectional view showing the relative size of a traditional manufacturing building and a building according to this invention.

In FIG. 4, a cross-section through a dryer section of the building 8 is superimposed upon a cross-section showing a standard type manufacturing building 82. The building 82 requires a truss superstructure 84 running the entire length of the building. This superstructure 84 provides support for the various trollies and tracks required for both lateral and longitudinal hoist and crane systems such as the lateral crane 86. The building 8 according to this invention has a significantly reduced cross section as compared to the dotted line outline of the building 82 with consequent savings in construction cost. The economy of constructing the industrial building structure system of this invention, even with the extra costs of the gantry crane structure and cooperating tracks, is very great when compared with the costs of constructing the old style building with internal hoists, cranes and trollies. Additionally, where the process being carried on within the building, requires good ventilation as is required in the manufacture of paper, the new style building 8 is more easily ventilated because the total cubic space enclosed by the building is much reduced.

Figure 5:
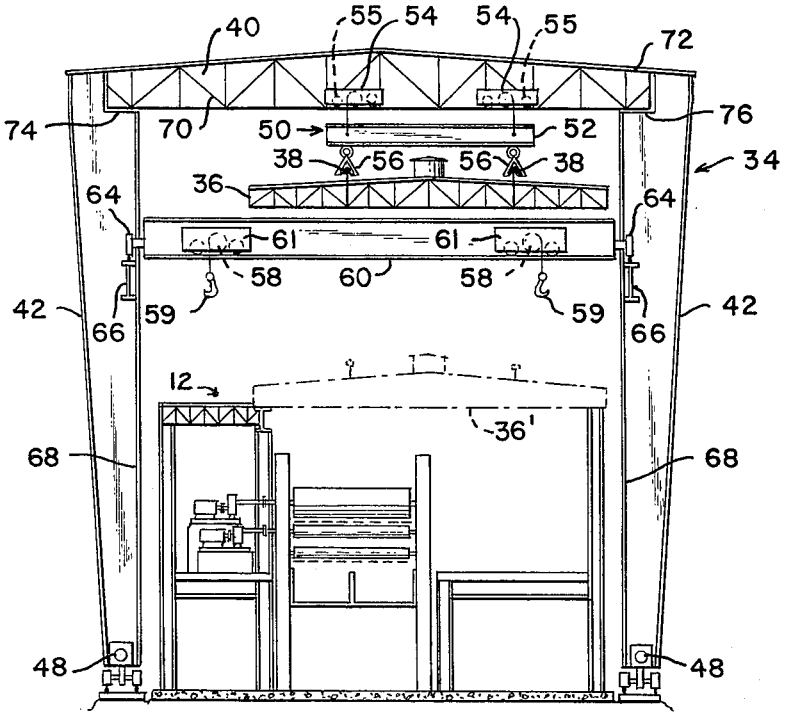
FIG. 5 is a cross-sectional view through the crane housing and the fourdrinier section of the building of FIG. 1.
Figure 6:
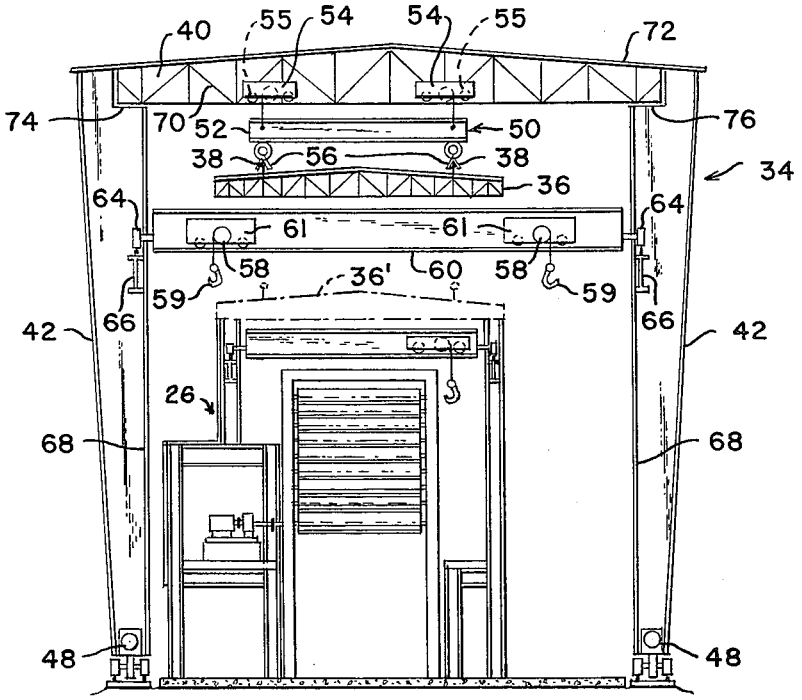
FIG. 6 is a cross-sectional view through the crane housing and calender section of the building of FIG. 1.
Figure 7:
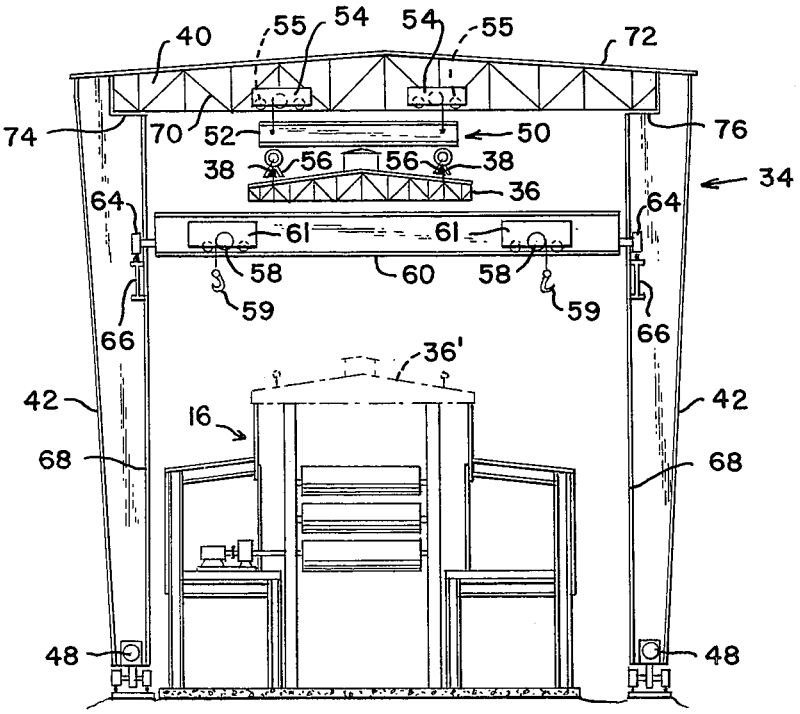
FIG. 7 is a cross-sectional view through the crane housing and the dryer section of the building of FIG. 1.

FIGS. 5, 6 and 7 show respectively sectional views through building 8 of the fourdrinier section 12, the calender section 26 and the dryer section 16. All the elements of the crane housing 34 are identified in FIG. 2. The gantry-type crane housing 34 is moved into place over any one of these sections with adequate clearance. Regardless of the particular building section, the fourdrinier, the calender and the dryer sections being representative of different cross sections, the crane housing 34 and its associated crane and hoist systems 50 and 58 are positioned for complete, flexible operation.

Preferably, the eye ring fittings 38 are positioned on each roof structure 36, regardless of size of the roof structure, so as to be compatible with the first crane system 50.

What is claimed is:

1. A crane housing system movable on track means positioned on each side of a building having individually removable roof structures, comprising:

a. a top structure laterally spanning the roof of the widest part of said building;

b. side wall members positioned exterior to said building and supporting said top structure for clearing the highest structural portion of said building;

c. transit means attached to said side wall members for moving said crane housing on said track means in a longitudinal direction relative to said building;

d. end wall sections vertically movable and cooperating with said top structure and said side walls members for substantially enclosing longitudinal sections of said building, said end wall sections conforming to the contour of the roof of said building, and e. crane means attached to said crane housing for removing a roof structure and suspending within said crane housing the removed roof structure during subsequent crane operations, said crane means including:

1. a first overhead crane adapted to raise or lower a roof section of said building, and

2. a plurality of second overhead cranes movable laterally of said crane housing.

2. The crane housing system as in claim 1 wherein said first overhead crane includes a hoist mechanism fixedly attached to said top structure of said crane housing, a rigid structural framework raised and lowered by said hoist mechanism, and releasable clamp members carried by said rigid structural framework for attaching to said roof structures of said building for removal thereof.

3. The crane housing system as in claim 1 wherein said transit means includes a motor drive and wheels driven by said motor drive cooperating with said track means.

4. The crane housing system as in claim 1 further including at least one pair of I beams having ends fixedly attached to respective side wall members providing supporting track means to carry at least one of said plurality of said second overhead cranes.

5. An industrial building structure system, including an overhead crane system, comprising:

a. an elongated building structure comprised of a plurality of longitudinally connected building sections of different cross-sections each having a removable roof section, said building structure being of relatively light construction sufficient for self-support and protection of the interior from the weather;

b. a crane housing including:

1. a stop structure of relatively heavy construction for supporting cranes and crane loads external of and laterally spanning the roof of said building structure and forming the top of said crane housing;

2. side members of relatively heavy construction for supporting said top structure above said building structure and positioned exterior to and adjacent the lateral sides of said building structure, said side members forming the sides of said crane housing;

c. transit means attached to said side members for moving said crane housing in a longitudinal direction relative to said building structure; said crane housing being independent of said elongated building structure and having a relatively short length with respect thereto; and d. crane means supported by said crane housing for removing and suspending said roof sections from said building structure and for crane suspension of items within said building structure.

6. The industrial building structure system as in claim 5 wherein said crane housing includes an enclosing means for protecting from the weather the interior of said building structure when one of said roof sections has been removed by said crane means.

7. The industrial building structure system as in claim 6 wherein said enclosing means comprises walls enclosing the external surfaces of said top structure and said side members and vertically movable end wall sections cooperating with said top structure and said side members and conforming to the contour of the roof sections on said building structure on either side of the roof section which has been removed.

8. The industrial building structure system as in claim 5 wherein said crane means includes a crane comprising a hoist mechanism attached to said top structure, a rigid structural framework raised and lowered by said hoist mechanism, and releasable clamp members carried by said rigid framework for attaching to said roof sections for their removal from said building structure.

9. The industrial building structure system as in claim 8 wherein said crane means also includes a plurality of overhead cranes mounted on said crane housing and movable laterally with respect to said crane housing.

10. An industrial building structure system, comprising:

a. an elongated building structure having a plurality of removable roof sections and being of relatively light construction sufficient for self-support and protection of the interior from the weather;

b. a crane housing including:

1. a top structure of relatively heavy construction external of and laterally spanning the roof of said building structure and forming the top of said crane housing;

2. side members of relatively heavy construction for supporting said top structure above said building structure and positioned exterior to and adjacent the lateral sides of said building structure forming the sides of said crane housing;

3. means enclosing said top structure and side members for protecting the interior of said building structure after removal of one of said roof sections;

c. transit means attached to said side members for moving said crane housing in a longitudinal direction relative to said building structure; said crane housing being independent of said elongated building structure and having a relatively short length with respect thereto; and d. a first crane comprising a hoist mechanism attached to said top structure, a rigid structural framework raised and lowered by said hoist mechanism, and releasable clamp members carried by said framework for attaching to said roof sections for their removal from said building structure and their suspension; and e. a plurality of second cranes mounted on said crane housing and movable laterally with respect to said crane housing.

* * * * *

UNITED STATES PATENT OFFICE

CERTIFICATE OF CORRECTION

Patent No. 3,961,712 Dated June 8, 1976

Inventor(s) Thomas S. Bartley

It is certified that error appears in the above-identified patent and that said Letters Patent are hereby corrected as shown below:

Claim 1, column 6, line 5, delete "walls" and substitute therefor ---wall---.

Claim 5, line 46, delete "stop" and substitute therefor ---top---.

Signed and Sealed this

Tenth Day of August 1976

[SEAL]

*Attest:*

RUTH C. MASON
*Attesting Officer*

C. MARSHALL DANN
*Commissioner of Patents and Trademarks*